US010537170B2

(12) United States Patent
McDaniel

(10) Patent No.: US 10,537,170 B2
(45) Date of Patent: Jan. 21, 2020

(54) FOLDING TABLE WITH SIMULTANEOUSLY EXTENDING LEGS

(71) Applicant: Lowell McDaniel, Corvallis, OR (US)

(72) Inventor: Lowell McDaniel, Corvallis, OR (US)

( * ) Notice: Subject to any disclaimer, the term of this patent is extended or adjusted under 35 U.S.C. 154(b) by 0 days.

(21) Appl. No.: 16/275,464

(22) Filed: Feb. 14, 2019

(65) Prior Publication Data

US 2019/0254416 A1 Aug. 22, 2019

Related U.S. Application Data

(60) Provisional application No. 62/631,717, filed on Feb. 17, 2018.

(51) Int. Cl.

| | |
|---|---|
| ***A47B 3/00*** | (2006.01) |
| ***A47B 3/08*** | (2006.01) |
| ***A47B 3/091*** | (2006.01) |

(52) U.S. Cl.

CPC ..... *A47B 3/002* (2013.01); *A47B 3/0818* (2013.01); *A47B 3/0916* (2013.01)

(58) Field of Classification Search

CPC ..... A47B 3/002; A47B 3/0818; A47B 3/916; A47B 2003/0824

USPC ..... 108/126

See application file for complete search history.

(56) References Cited

U.S. PATENT DOCUMENTS 415,841 A 11/1889 Lee
920,253 A 5/1909 Boeswinkle
1,240,964 A * 9/1917 Franks ..... A47B 3/0916 108/126
1,697,594 A 1/1929 Gowell
1,814,838 A 7/1931 Martin
1,859,121 A * 5/1932 Wilkinson ..... A47B 3/0916 108/126
1,909,905 A * 5/1933 Simmons ..... A47B 3/0916 108/126
1,924,223 A * 8/1933 Weatherly ..... A47B 3/0912 108/126
1,943,563 A * 1/1934 Stoner ..... A47B 3/0916 108/130
1,990,817 A * 2/1935 Culver ..... A47B 3/0912 108/126
2,019,932 A * 11/1935 Ray ..... A47B 3/0916 108/127
2,022,345 A * 11/1935 Hansen ..... A47B 3/0916 108/126
2,074,123 A * 3/1937 Jackson ..... A47B 3/0916 108/126

(Continued)

*Primary Examiner* — Daniel J Troy
*Assistant Examiner* — Timothy M Ayres
(74) *Attorney, Agent, or Firm* — Trenner Law Firm, LLC; Mark D. Trenner

(57) ABSTRACT

An example folding table with simultaneously extending legs includes a table top structure. The example table also includes a plurality of table legs to support the table top structure. Each of the table legs part of a spherical four bar linkage. The example table also includes a plurality of driver links for the plurality of table legs. The driver links each part of a single driver component with a pivot at a center of the table top structure. The example table also includes a rotating coupler for on each end of the driver links. When one of the table legs is folded and unfolded, the other table legs move simultaneously in a first direction to open and in a second direction to retract.

17 Claims, 19 Drawing Sheets

(56) References Cited

U.S. PATENT DOCUMENTS

| | | | | |
|---|---|---|---|---|
| 2,089,318 | A | 8/1937 | Willson | |
| 2,184,695 | A | 12/1939 | Findley | |
| 2,209,142 | A * | 7/1940 | Sloan ..... | A47B 3/0912 108/126 |
| 2,243,018 | A | 5/1941 | Senft | |
| 2,277,435 | A | 3/1942 | Howe | |
| 2,291,967 | A | 8/1942 | Keahey | |
| 2,343,537 | A | 3/1944 | Saussure | |
| 2,423,529 | A | 7/1947 | Taylor | |
| 4,974,526 | A | 12/1990 | Wiygul, Jr. | |
| 5,941,181 | A | 8/1999 | Hornberger et al. | |
| D489,922 | S | 5/2004 | Choi et al. | |
| 6,779,466 | B2 | 8/2004 | Shabram, Jr. | |
| 7,011,364 | B2 | 3/2006 | Meskill et al. | |
| 7,063,025 | B2 | 6/2006 | Ashby et al. | |
| 2007/0251427 | A1 | 11/2007 | Ripamonti et al. | |

* cited by examiner

FOLDING TABLE WITH SIMULTANEOUSLY EXTENDING LEGS

CROSS REFERENCE TO RELATED APPLICATIONS

This application claims the priority benefit of U.S. Provisional Patent Application No. 62/631,717 filed Feb. 17, 2018 for "Folding Table With Simultaneously Extending Legs," hereby incorporated by reference in its entirety as though fully set forth herein.

BACKGROUND

Folding tables (sometimes called card tables) normally require the user to extend and lock each of the four legs, one at time. This can be a difficult and slow process. As such, many users will just leave the table set up, defeating the purpose of having a folding table.

DETAILED DESCRIPTION

A folding table with simultaneously extending legs is disclosed which can be readily set up and taken down. In an example, each leg of the table is part of a spherical four bar linkage or driver component. The driver links are each part of a single driver component with a pivot at the center of the table. The legs are connected to the driver component with coupler having pivots or hinges on each end.

In an example, the corner hinges make an angle of about 35 degrees with the surface of the table. This feature makes the linkage of the legs possible. When one leg is unfolded, the other legs unfold simultaneously. The table legs move simultaneously for rapid unfolding and retraction. For example, the legs can extend and lock in less than five seconds. In an example, when the linkage is latched before the legs are fully unfolded, some height adjustment is possible.

Before continuing, it is noted that as used herein, the terms "includes" and "including" mean, but is not limited to, "includes" or "including" and "includes at least" or "including at least." The term "based on" means "based on" and "based at least in part on."

Figure 1:
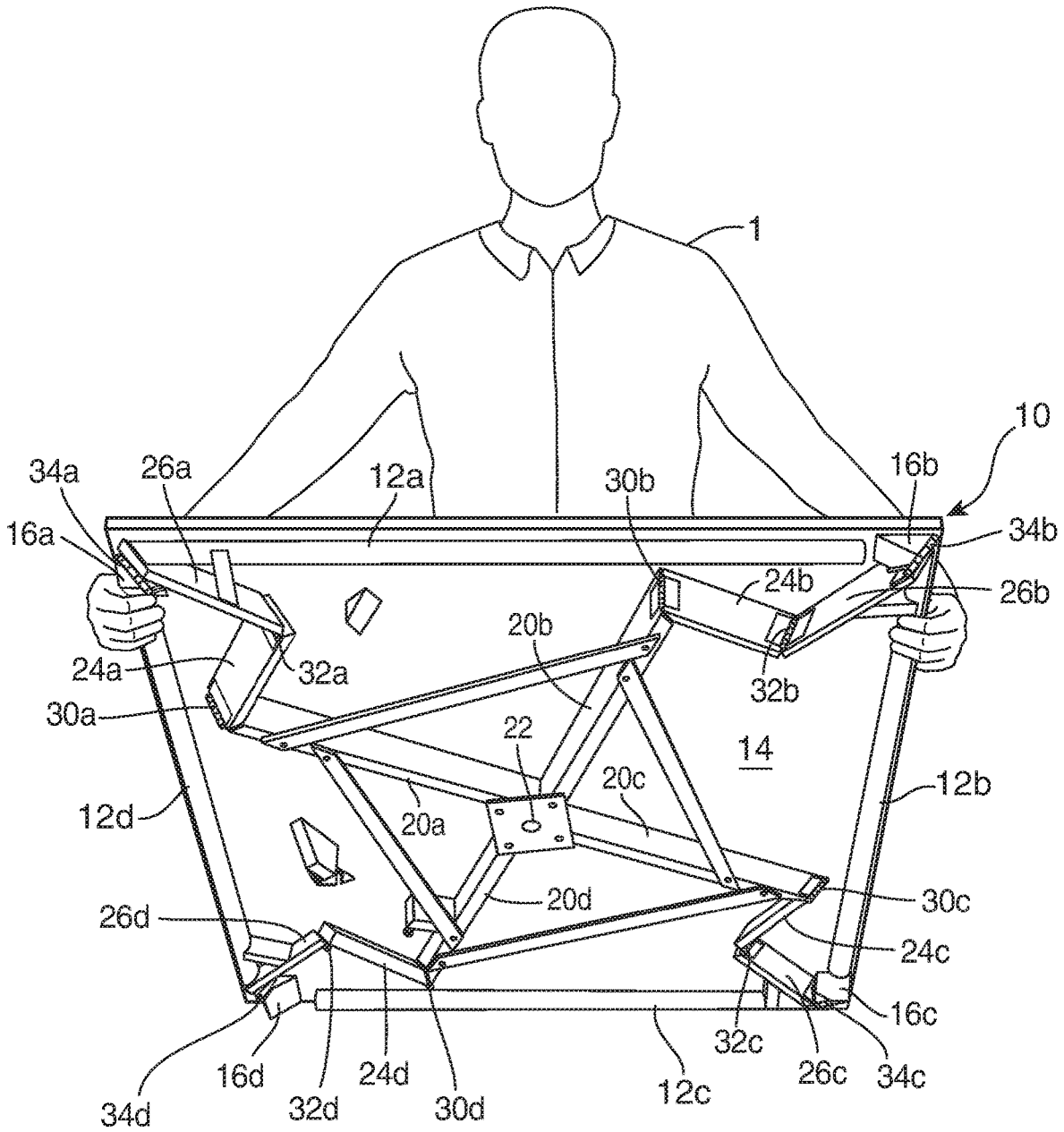
FIG. 1 illustrates an example folding table with simultaneously extending legs, as the table may be held with the legs in a retracted position.
Figure 2:
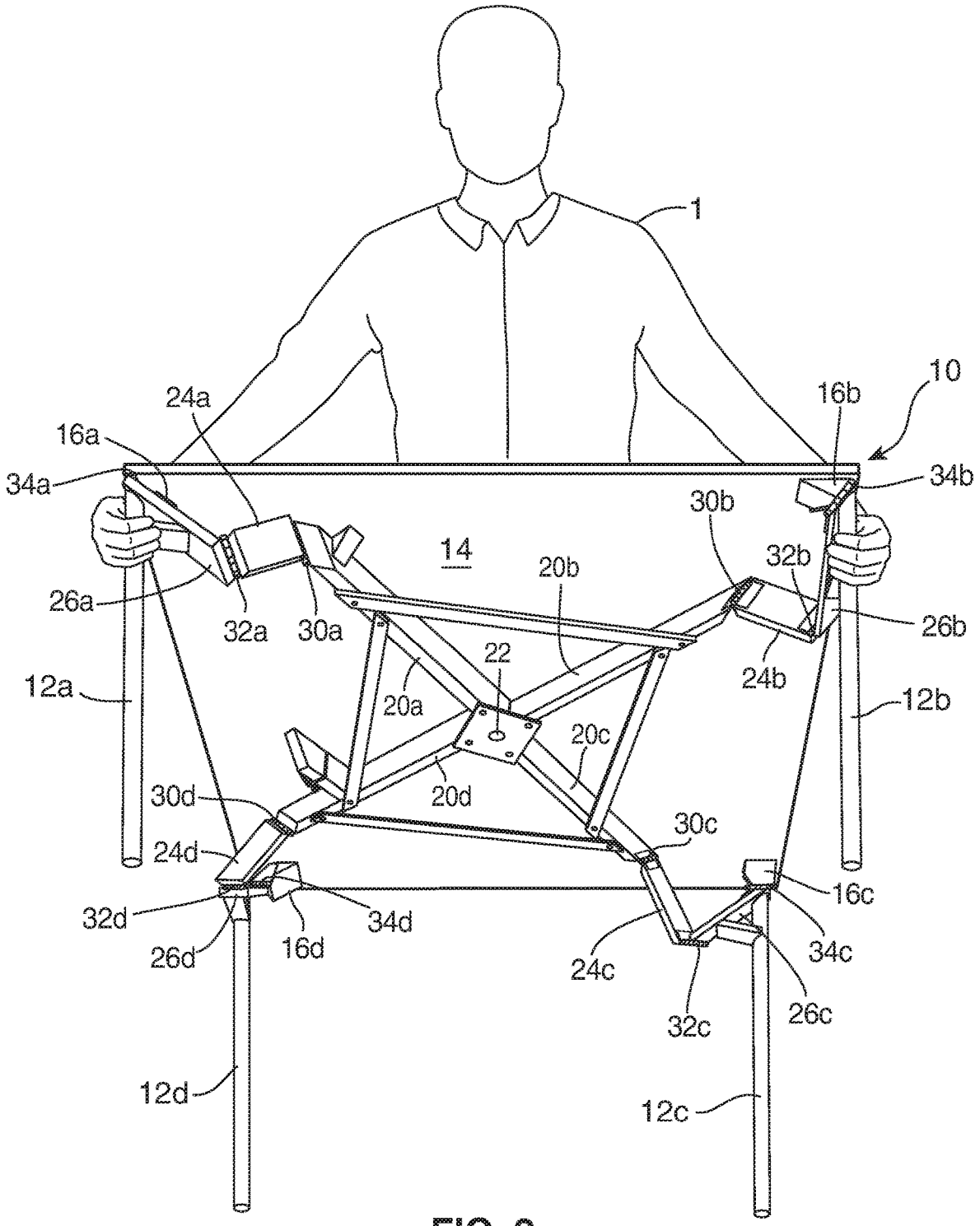
FIG. 2 illustrates the example folding table with simultaneously extending legs, as the table may be held with the legs in an extended position.

FIG. 1 illustrates an example folding table 10 with simultaneously extending legs, as the table 10 may be held with the table legs (or "legs") 12*a-d* in a retracted position. FIG. 2 illustrates the example folding table 10 with simultaneously extending legs, as the table 10 may be held with the legs 12*a-d* in an extended position.

In an example, the table 10 is simply flipped over or inverted (e.g., by a user 1) and the legs 12*a-d* automatically open into the extended position. In another example, the user may disengage one of the legs 12*a-d* (e.g., from a latch), and then the legs 12*a-d* move into the extended position.

In an example, the legs 12*a-d* may move into the extended position under the force of gravity (e.g., automatically when the table 10 is inverted). In another example, the legs 12*a-d* may move manually. For example, the user 1 may move at least one of the legs (e.g., 12*a*) thereby causing the remaining legs (e.g., 12*b-d*) to extend.

Figure 3:
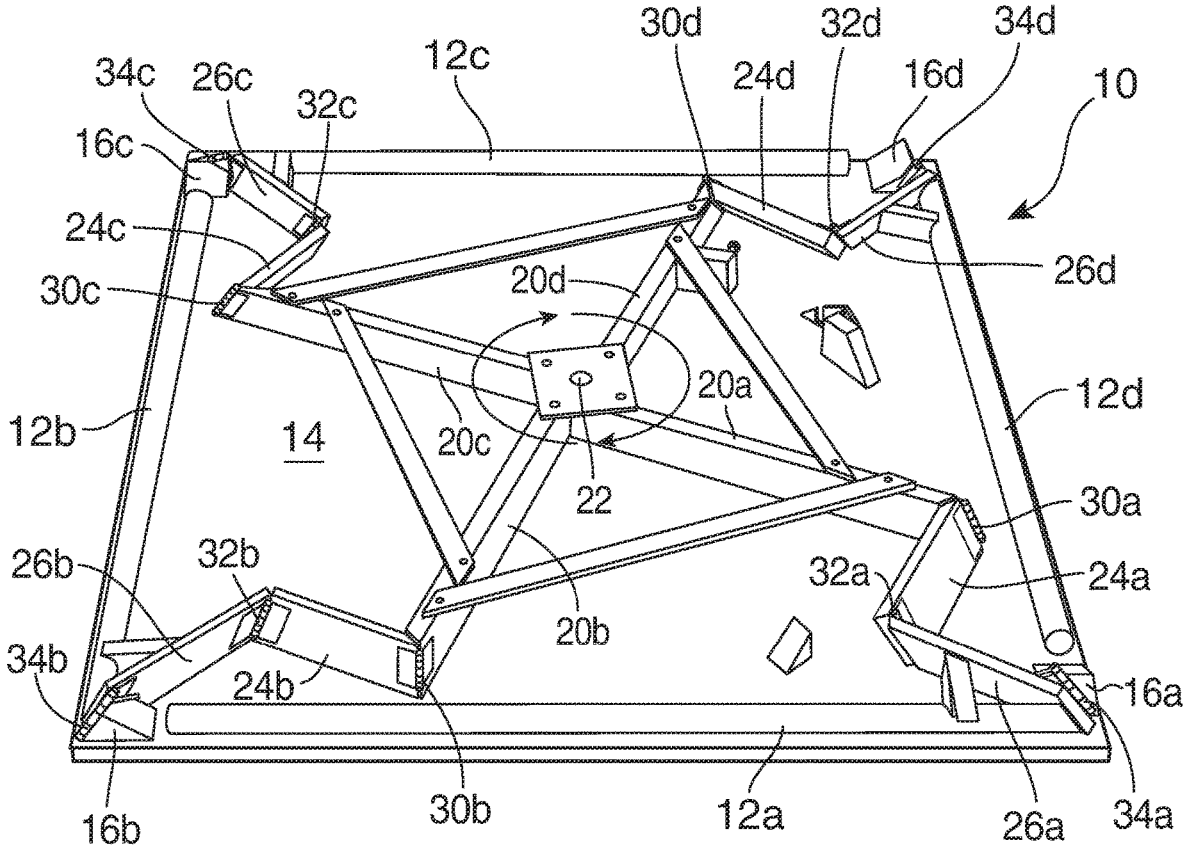
FIGS. 3-5 illustrate example operation of the example folding table with simultaneously extending legs.
Figure 4:
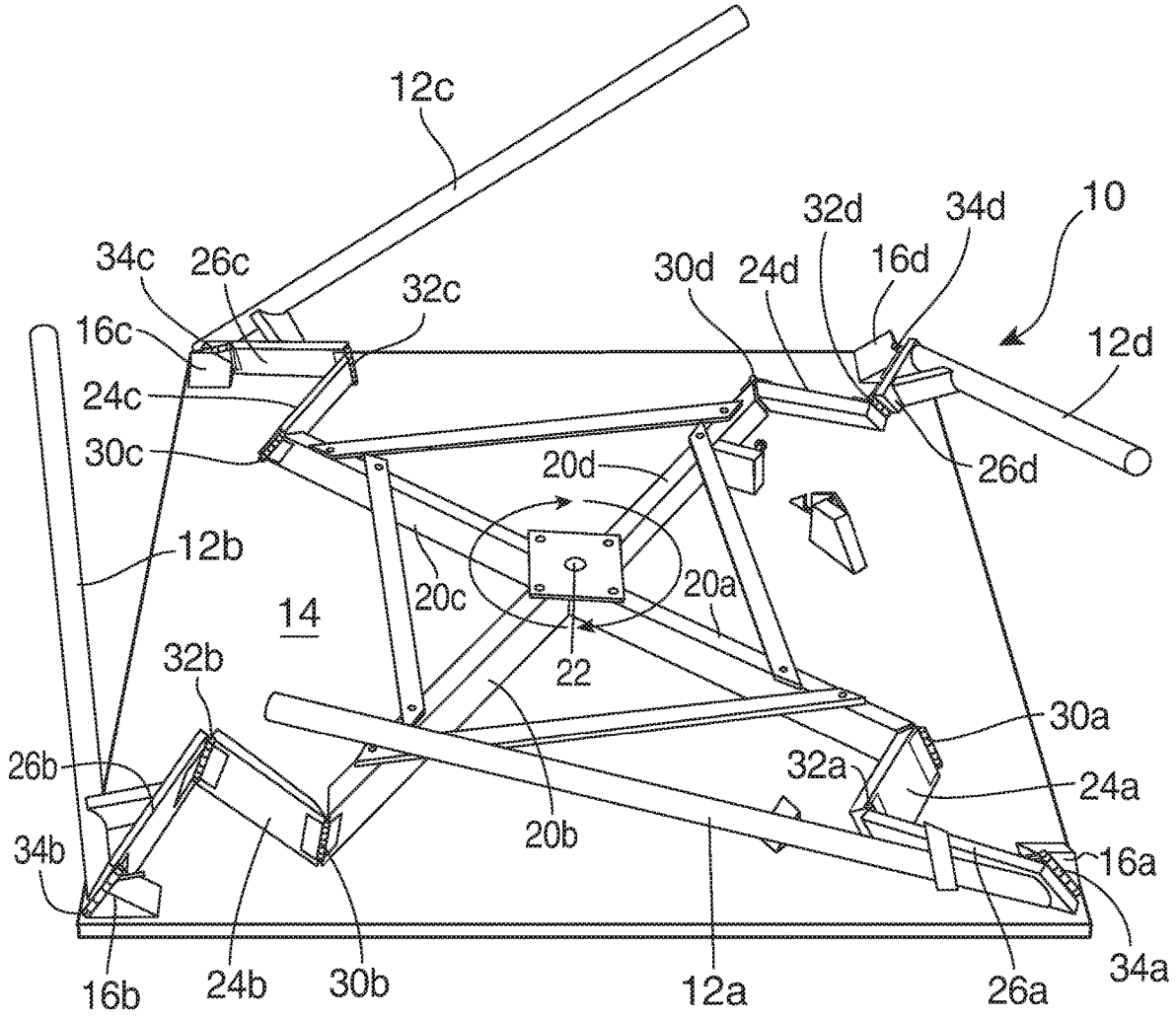
Figure 5:
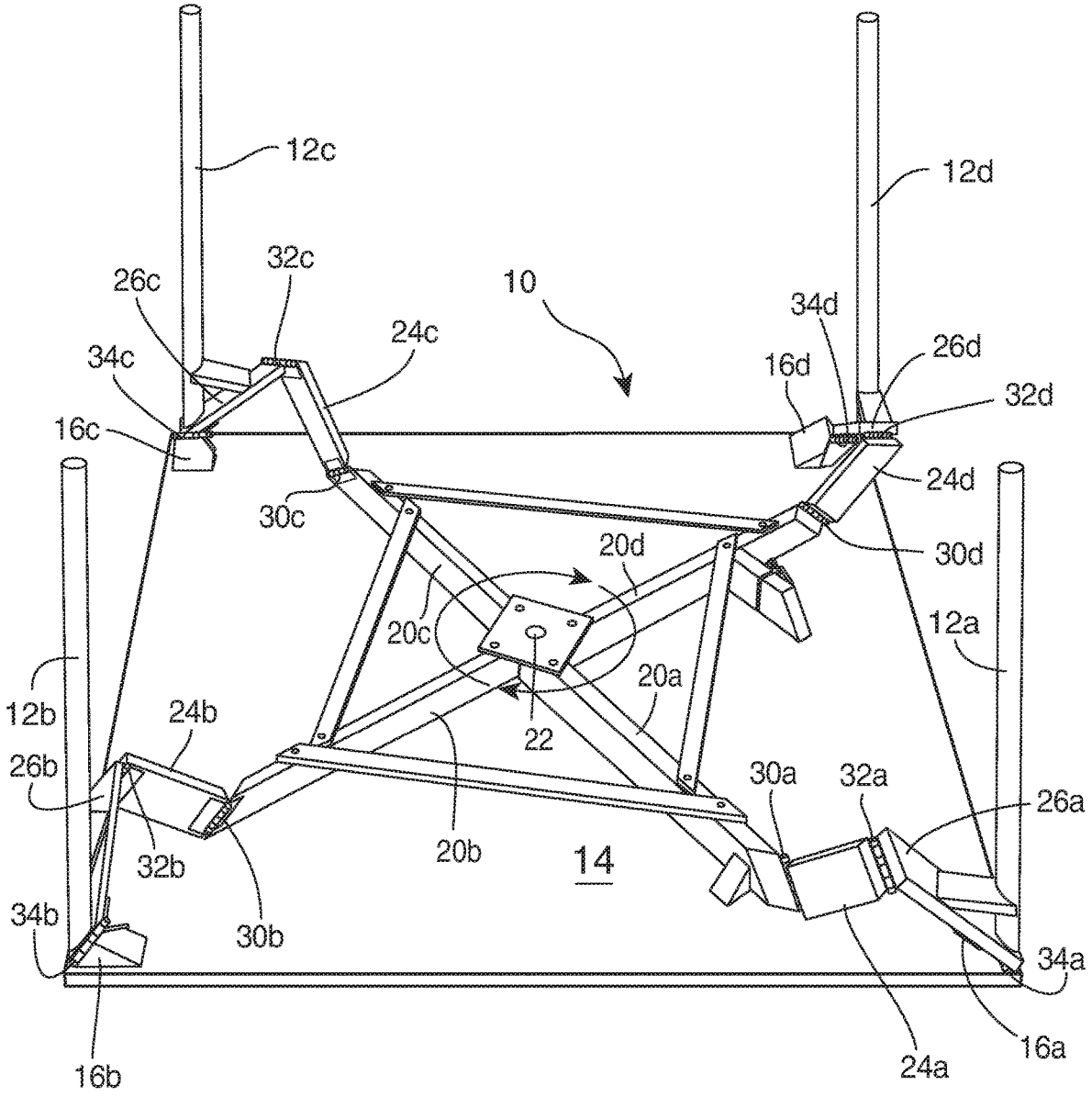
Figure 6A:
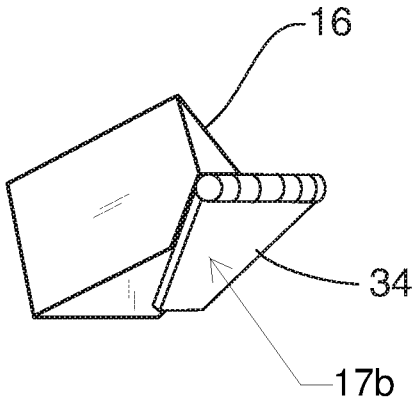
FIGS. 6A-6B are detailed views of an example leg support member.
Figure 6B:
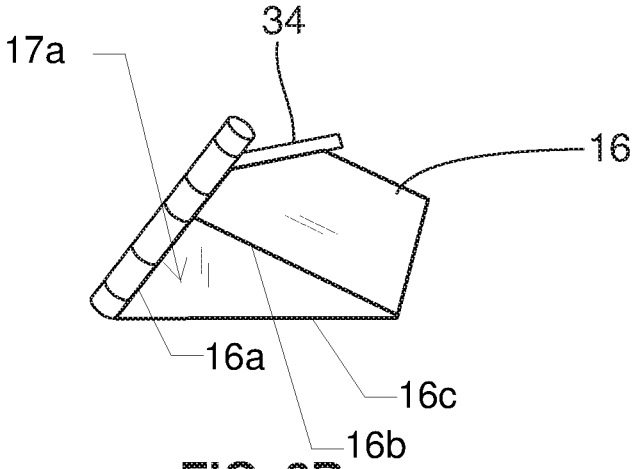
Figure 7:
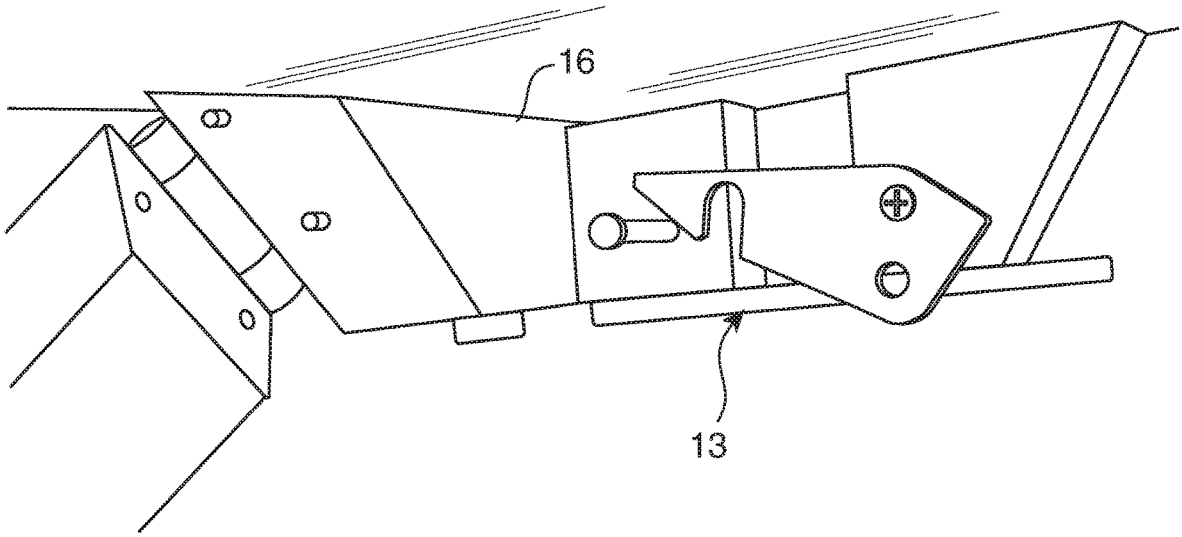
FIGS. 7-8 are close-up perspective views of a latch for the example folding table with simultaneously extending legs.
Figure 8:
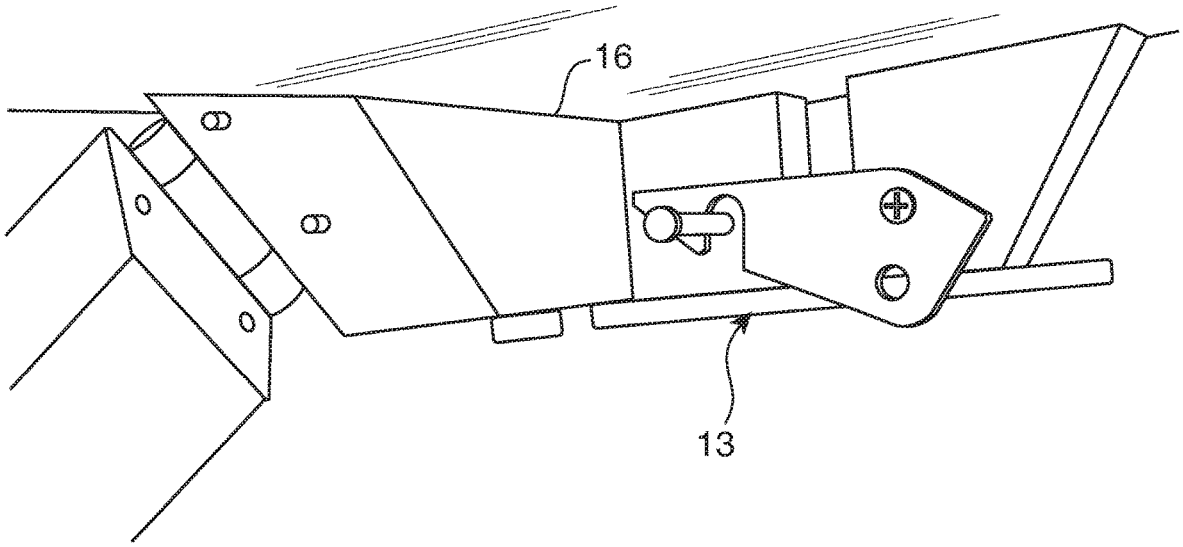

FIGS. 3-5 illustrate in more detail an example operation of the folding table 10 with simultaneously extending legs 12*a-d*. In an example, one of the legs 12*a-d* of the table 10 causes, via the linkage, the other three legs to also extend. The user may press the linkage into place and/or use a latch to secure the legs 12*a-d* in the extended position. FIGS. 6A-6B are detailed views of an example leg support member (attached to plywood or other surface) 16. Each leg support member 16 is shown having a number of faces, each face defined by a plurality of edges. Edges 16*a*, 16*b*, and 16*c* are arranged adjacent to one another to form a triangular-shaped face 17*a* of the leg support member 16. Each leg support member 16 also has a hinge face 17*b* (under hinge 34) angled relative to the triangular-shaped face 17*a* to receive the first hinge 34 thereon. FIGS. 7-8 are close-up perspective views of an example latch 13 for the example folding table 10. However, any suitable latch mechanism may be implemented.

Examples of a latching device can be a magnetic cabinet door latch, e.g., retracted by flipping the table in the reverse direction (or by inverting the table and quickly rotating it about a vertical axis to get the driver link component to start rotation). The user first unlatches the driver link component and rotates it a few degrees in a direction that starts the folding process. After this is done to an inverted table gravity causes the legs to retract.

In another example, a separate latching device need not be provided, and the legs 12*a-d* can be latched under tension.

Flipping the table over causes the legs 12*a-d* to automatically release and unfold into a standing position. The legs 12*a-d* are automatically folded or retracted by flipping the table 10 in the reverse direction. Again, the user may press the linkage into place and/or use a latch 13 to secure the legs 12*a-d* in the retracted position.

The example folding table 10 is illustrated in FIGS. 1-5 as it may include a table top structure 14. A leg support member 16 (FIGS. 6A and 6B) is provided on each corner (members 16*a-d*) of the table top structure 14, to movably (e.g., via hinge, pivot, etc.) attach each of the legs 12*a-d* to the corners of the table top structure 14.

It is noted that the mechanisms described herein may be implemented on any suitable table, including different shape tables (e.g., round, triangular) and tables having a different number of legs (e.g., 3, 5, 6, etc.).

In an example, the table 10 has a four bar linkage pivotally connected in a center of the table top structure 14. The four bar linkage includes four separate bars 20*a-d*, The bars 20*a-d* extend out from the center of the table top structure 14 and are configured substantially perpendicular to the adjacent bars. For example bar 20*a* is perpendicular to bar 20*b* and bar 20*d*; bar 20*b* is perpendicular to bar 20*a* and bar 20*c*; and so forth. During operation, the four bar linkage rotates about the center of the table (e.g., at pivot 22). In the example shown, the four bar linkage rotates in a clockwise direction, although the mechanism is not limited to rotation on the clockwise direction, and in other examples may be a counter-clockwise rotation.

A coupler link or first folding member 24*a-d* is rotatably connected at an end of each of the four separate bars 20*a-d*, respectively. In an example, the first folding member 24*a-d* is movably connected by a hinge, but other pivoting attachment may be implemented. A driven link or second folding member 26*a-d* is movably connected to the corresponding first folding member 24*a-d* on one end, and the second folding member 26*a-d* is rotatably connected to a corresponding leg support member 16*a-d* on a second end of the second folding member.

It is noted that the base link of the four-bar linkage is the part of the table top structure 14 between a corner hinge and the center pivot. The driver link rotates about the center pivot. The driven link rotates about the corner hinge pin. The coupler link joins the driver link and driven link with hinges (or other moveable connection).

In an example, the first folding member 24*a-d* is connected to the end of the respective bar 20*a-d* by a pivot member 30*a-d*. The pivot member 30*a-d* is shown as a hinge, but may be a pivot pin or other connection which enables movement therebetween. The second folding member 26*a-d* is also movably connected on both ends by pivot members. For example, pivot members 32*a-d* connect to first folding member 24*a-d*, and pivot members 34*a-d* connect to the leg support members 16*a-d*. Pivot members 32*a-d* and 34*a-d* are shown as hinges, but may be a pivot pin or other connection which enables movement therebetween. It is noted that a pivot pin through sheet metal is still a hinge, with a pivot pin that is in a line through point P. Ball and socket joints may also be used, albeit are generally more expensive.

In an example, each of the table legs 12*a-d* that support the table top structure 14 are connected to the respective second folding member 26*a-d*, e.g., at the respective leg support member 16*a-d*. When one of the table legs 12*a-d* is folded and unfolded, the other table legs move simultaneously in a first direction to open or extend, and in a second direction to retract or fold.

In an example, rotation of the four bar linkage about the center of the table top structure 14 causes the first folding member 24*a-d* to move away from the table top structure 14. The first folding member 24*a-d* moving away from the table top structure 14 also causes the second folding member 26*a-d* to move away from the table top structure 14. The first folding member 24*a-d* and the second folding member 26*a-d* are mounted at angles, which according to this movement, cause the table legs 12*a-d* to move simultaneously in a first direction to open or extend, and in a second direction to retract.

The initial direction of the tip of the extending leg makes about a 45 degree angle with the surface of the table. This allows a reasonably positioned frame around the legs and linkage as in an ordinary card table. The frame can provide the rigidity. The top surface 14 can be thin and light while providing cross-bracing for the outside frame of the table top structure 14.

If one tries to reach full extension of the legs by moving a single leg slowly, the theoretical force needed to achieve full extension is infinite. To achieve full extension, a final nudge on the driver member is needed. The latch could see very little force. This means that full extension is robust and the table resists collapsing.

It is very natural to want to achieve full leg extension by moving a single leg only without the need to finish the job with a final nudge on the driver member. In another example, the fully extended configuration may be a few degrees less and the latch may provide some of the stabilizing force. This way full extension and latching can be had by only moving a single leg slowly. It still works if the motion is fast enough that the inertia of the driver member substitutes for manually nudging it.

The operations shown and described herein are provided to illustrate example implementations. It is noted that the operations are not limited to the ordering shown. Still other operations may also be implemented.

It is noted that the examples described above are provided for purposes of illustration, and are not intended to be limiting. Other devices and/or device configurations may be utilized to carry out the operations described herein.

Figure 9:
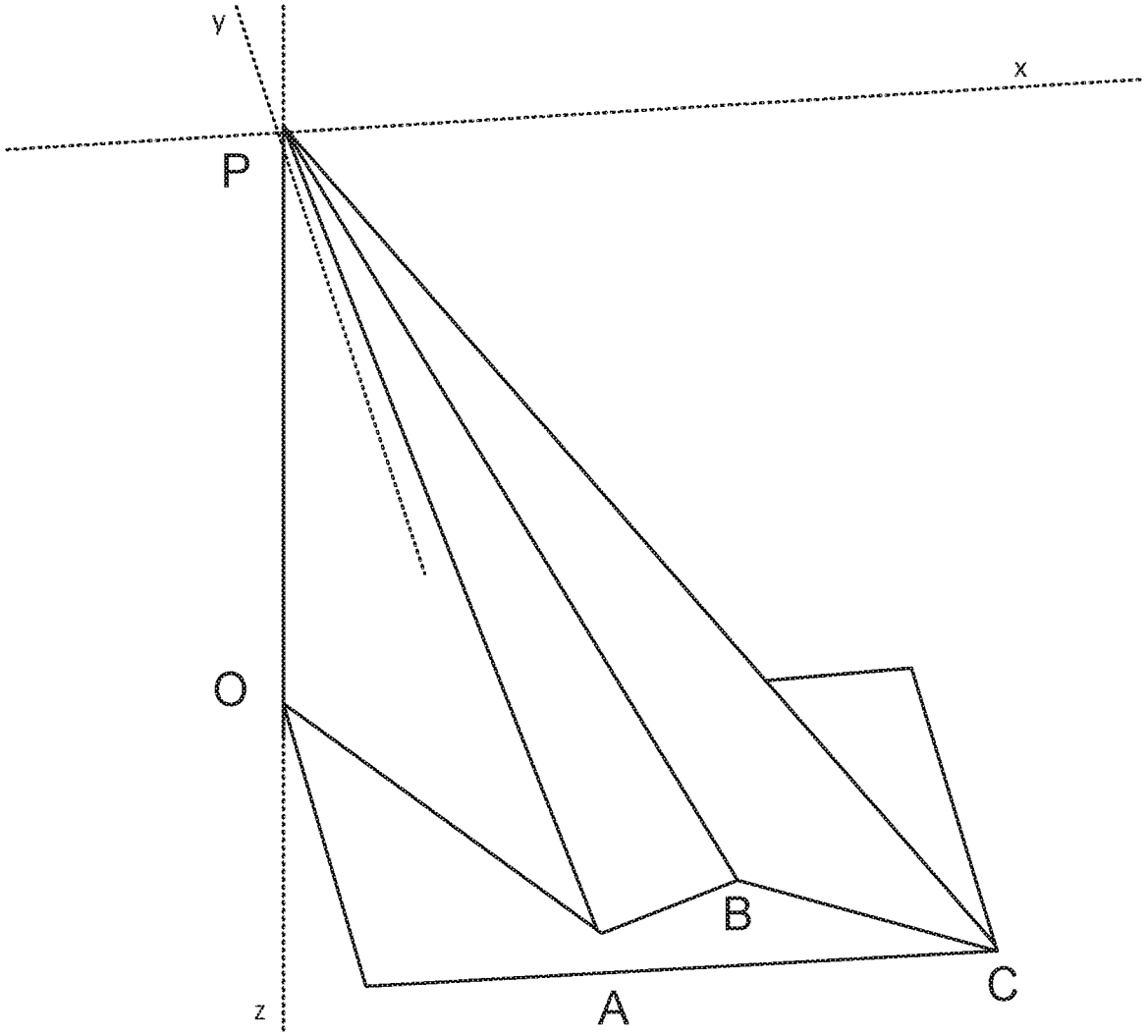
FIG. 9 is an oblique view illustrating the geometry of one quadrant of an example folding table with simultaneously extending legs, shown with the table inverted and leg retracted.
Figure 10:
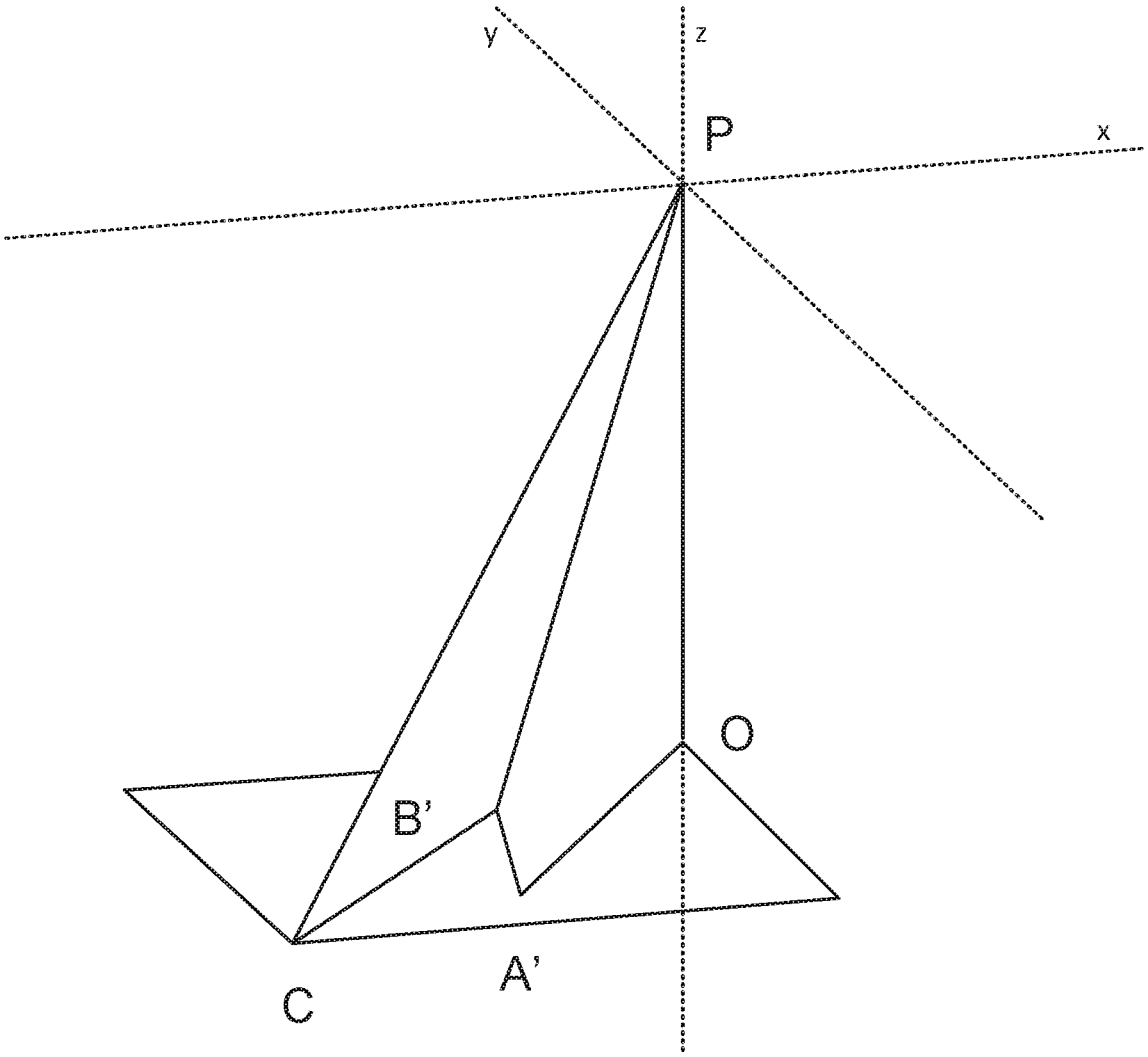
FIG. 10 is an oblique view illustrating the geometry of one quadrant of an example folding table with simultaneously extending legs, shown with the table inverted and leg extended.

As mentioned above, the geometry of the leg support member 16*a-d*, in conjunction with the configuration and operation of the folding members 24*a-d* and 26*a-d*, enables rotation of the driver link to effect an unfolding of the table legs into an extended position (and folding back into the retracted position). FIG. 9 is an oblique view illustrating the geometry of one quadrant of an example folding table with simultaneously extending legs, shown with the table inverted and leg retracted. FIG. 10 is an oblique view illustrating the geometry of one quadrant of an example folding table with simultaneously extending legs, shown with the table inverted and leg extended. Primed point labels designate the extended configuration.

The explanation and equations below are described with regard to a class of linkages which may be implemented. This description is for purposes of illustration, and principles described herein may be applied to other components and/or configuration of components. Still other configurations and/or components may be implemented, as will be readily understood by those having ordinary skill in the art after becoming familiar with the teachings herein.

In an example, the linkage may be a driver component that includes the four driver arms or bars 20*a-d*. These bars 20*a-d* rotate about an axis normal to the plane of the table top structure 14, substantially at the center of the table top structure 14. A plurality (e.g., four) of legs 12*a-d* are hinged at the corners of the table top structure 14, e.g., to folding members 26*a-d* at leg support members 16*a-d*. Individual coupler links (e.g., folding members 24*a-d* and 26*a-d*) connect to the driver component and the legs 12*a-d* via pivots, hinges, or other movable connections.

In an example, the linkage includes a spherical 4-bar linkage, with each driver link as part of the driver component. The term spherical refers to the rotation about the center of the table top structure 14. Each hinge (or other connection) in the system has a rotation axis that always passes through a point, P, as can be seen in FIGS. 9 and 10. The lines represent links that lie in the plane of the table in the folded position. For example, Link BC and B'C is part of the table leg. The terms can be expressed mathematically as follows:

r=the length of line segments OA and OA' l=the length of line segments AB and A'B' p=the length of line segments BC and B'C

θi=the angle between segment OA and the y-axis in the retracted configuration

θf=the angle between segment OA' and the v-axis in the extended configuration

Coordinates of the points in FIGS. 1, 2, & 3 appear below.

A(r·cos(θi), r·sin(θi), 0); A'(r·cos(θf), r·sin(θf), 0)

B(a, b, c); B'(b, h-c, h-a)

C(h, h, 0)

O(0, 0, 0)

P(0, 0, h)

Figure 11:
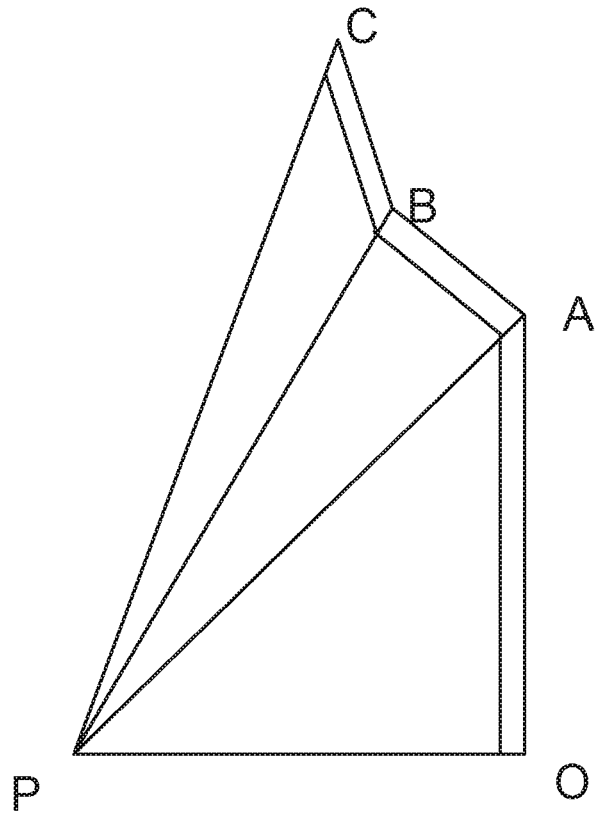
FIG. 11 is illustrates the geometry of one quadrant of an example folding table with simultaneously extending legs with the links laid out flat.
Figure 12:
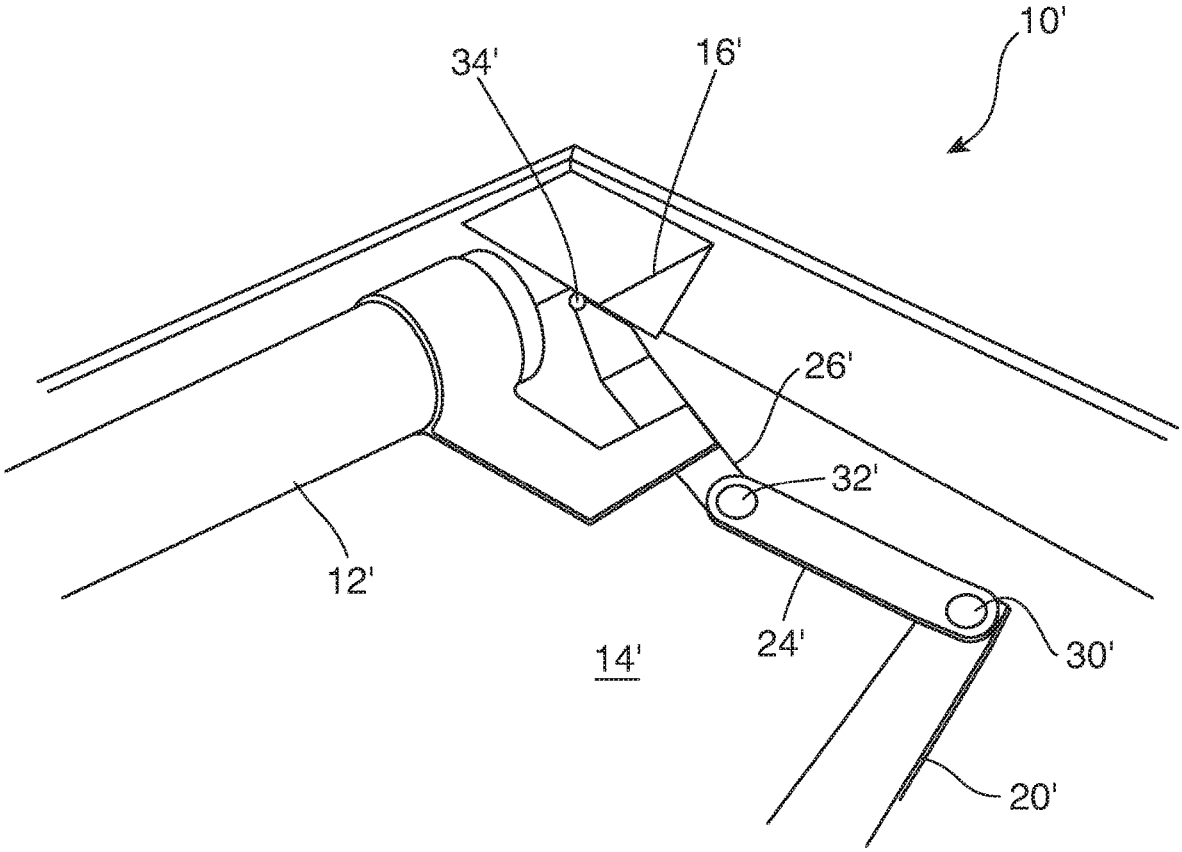
FIG. 12-15 illustrate example operation of another example folding table with simultaneously extending legs.
Figure 13:
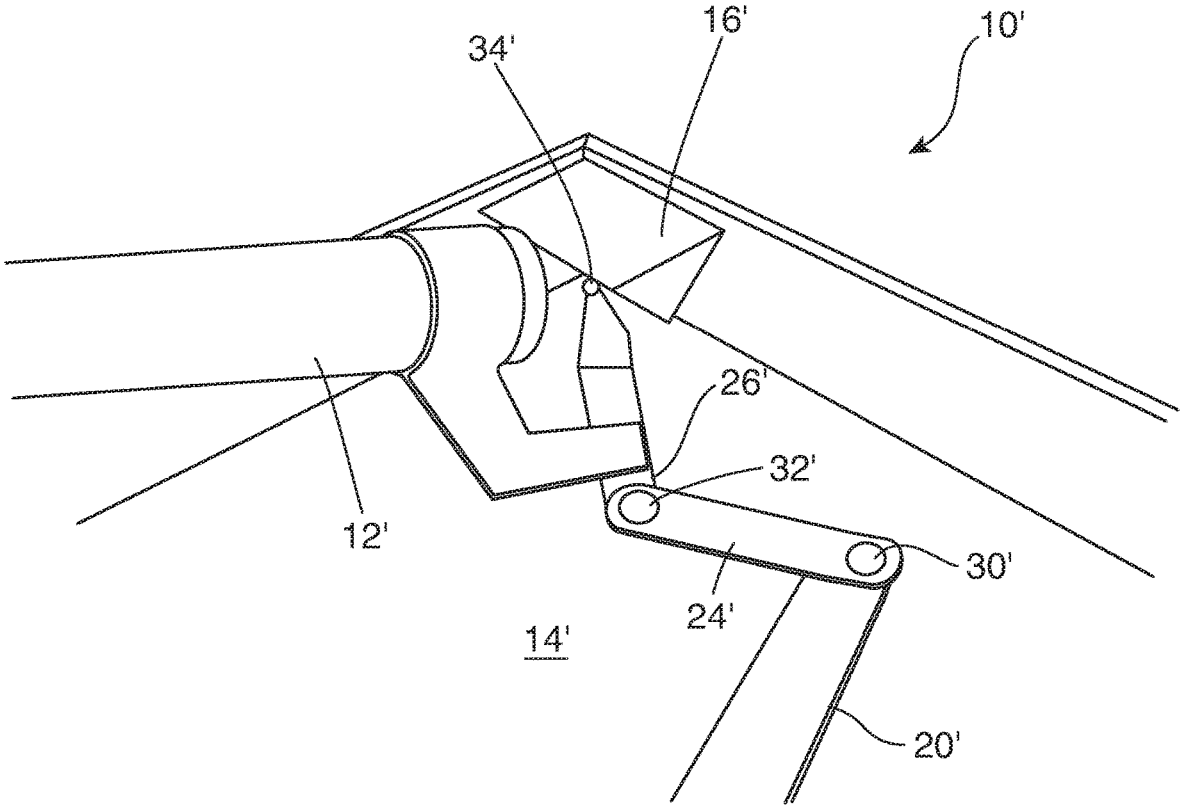
Figure 14:
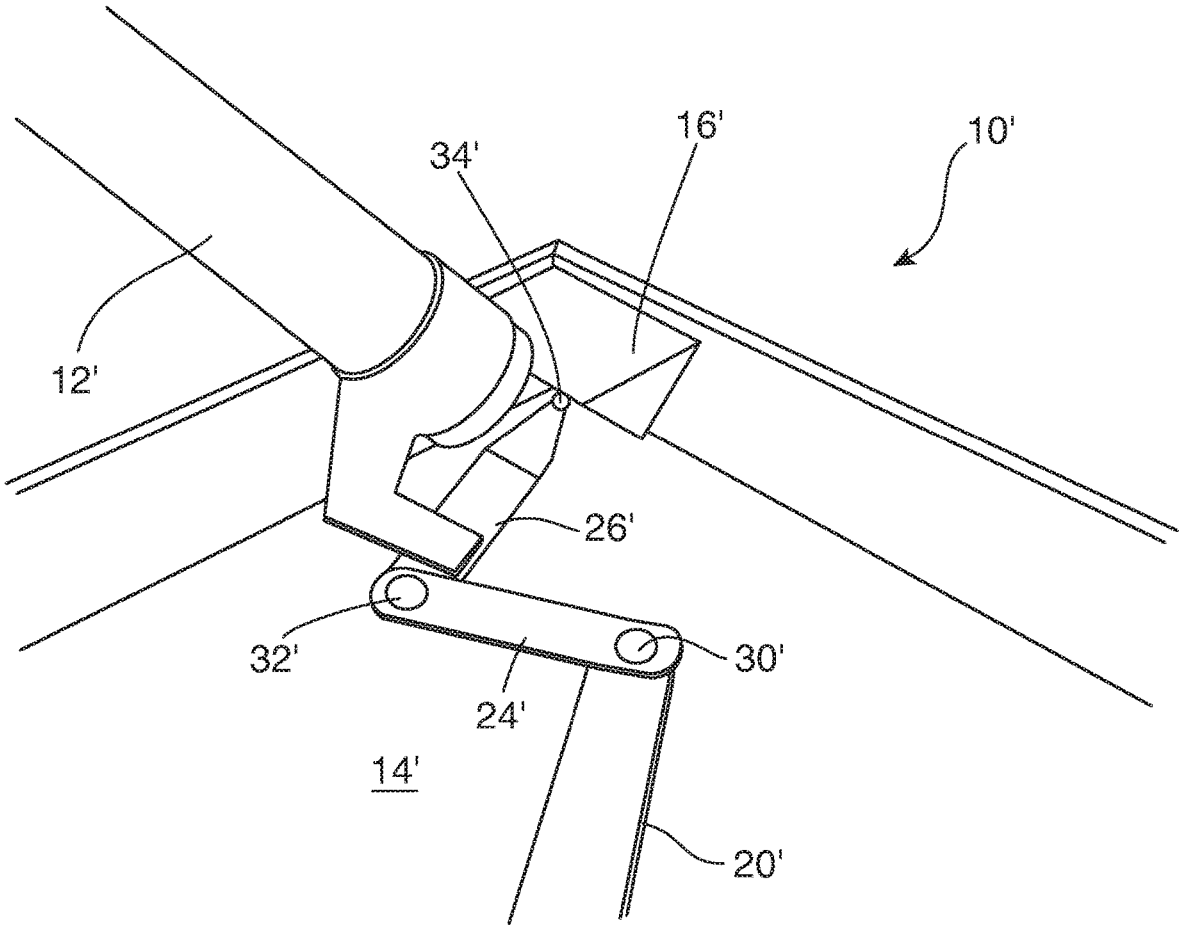
Figure 15:
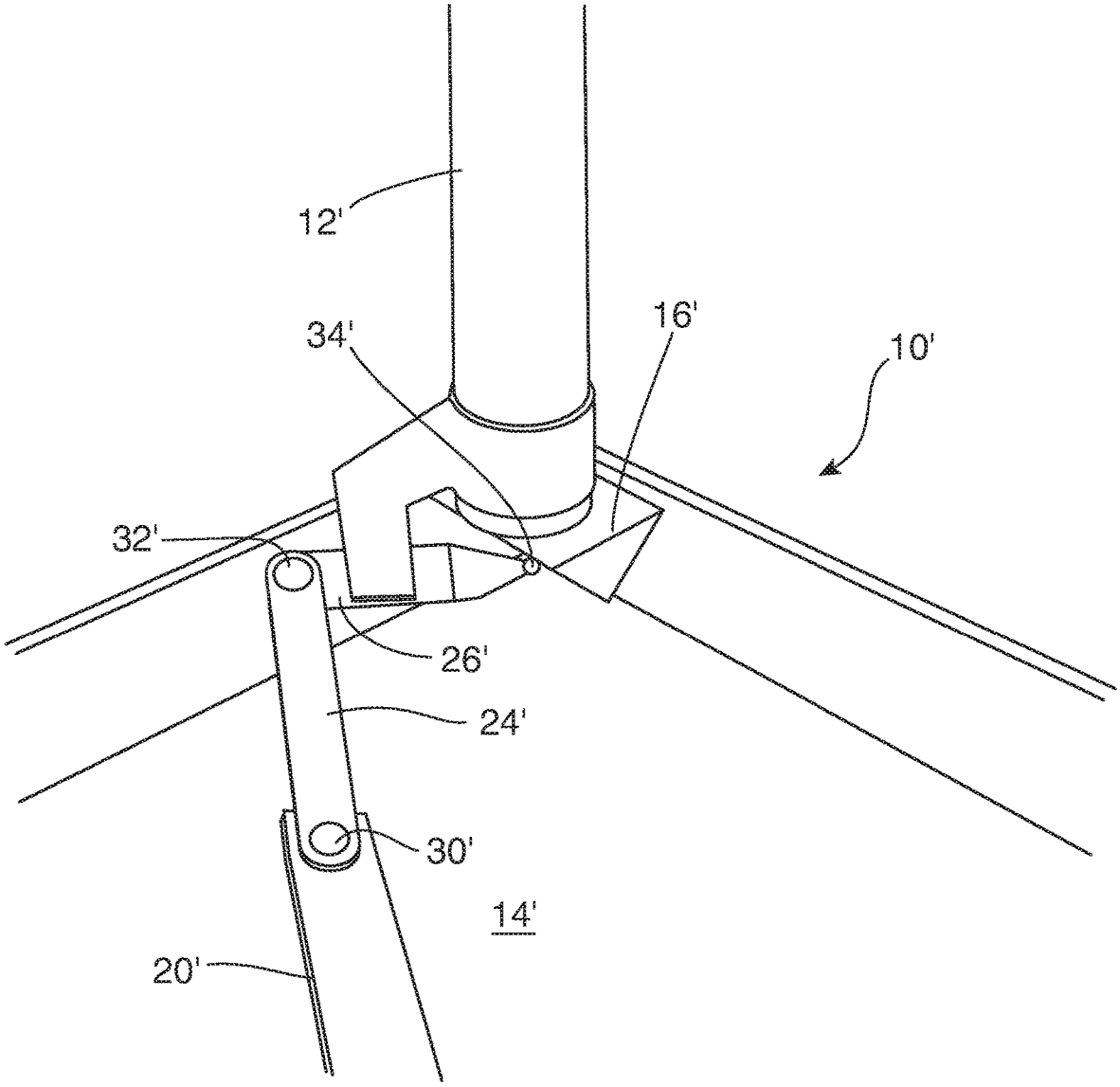
Figure 16:
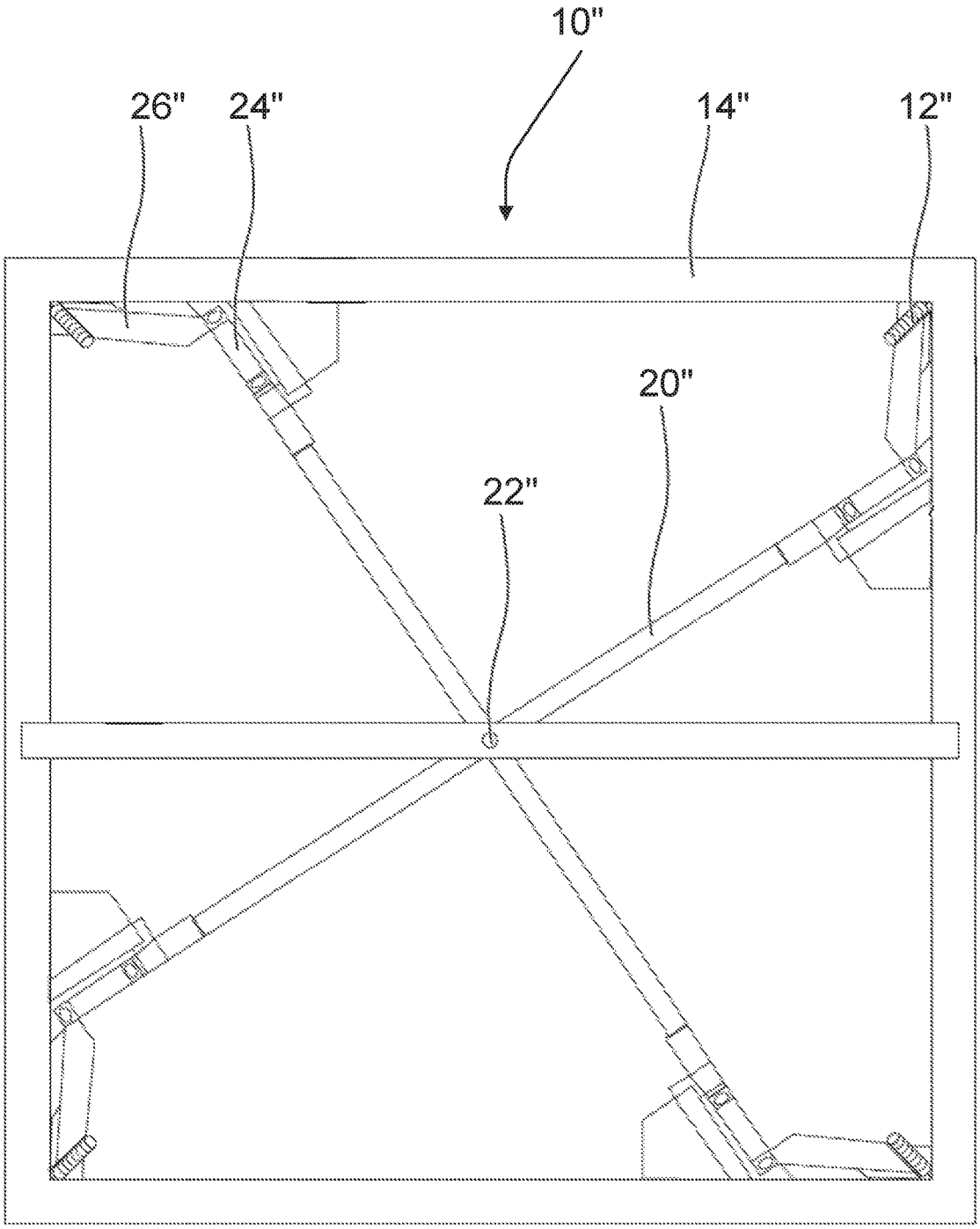
FIGS. 16-19 illustrate the example folding table with simultaneously extending legs incorporating the mechanism of FIGS. 12-15.
Figure 17:
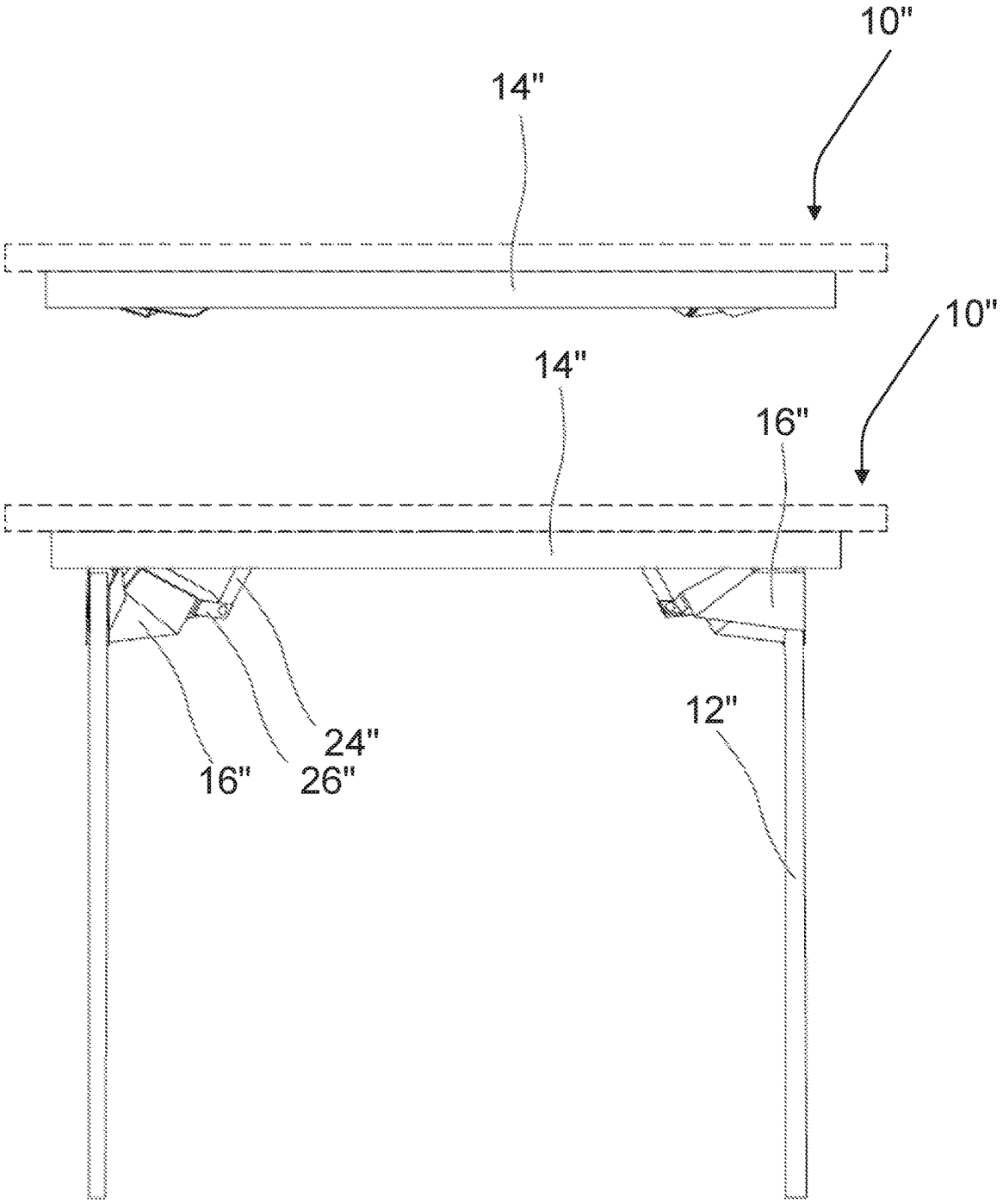
Figure 18:
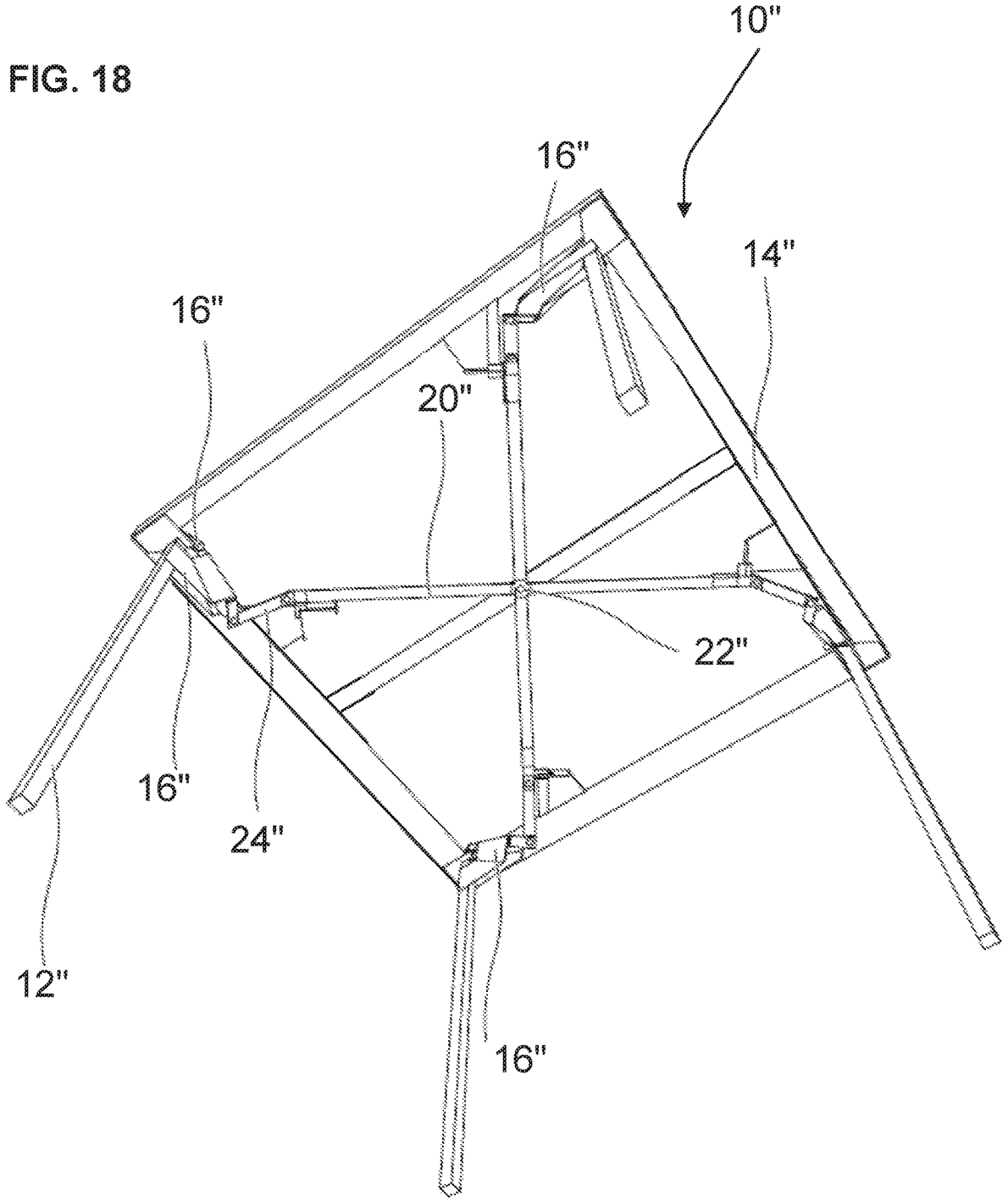
Figure 19:
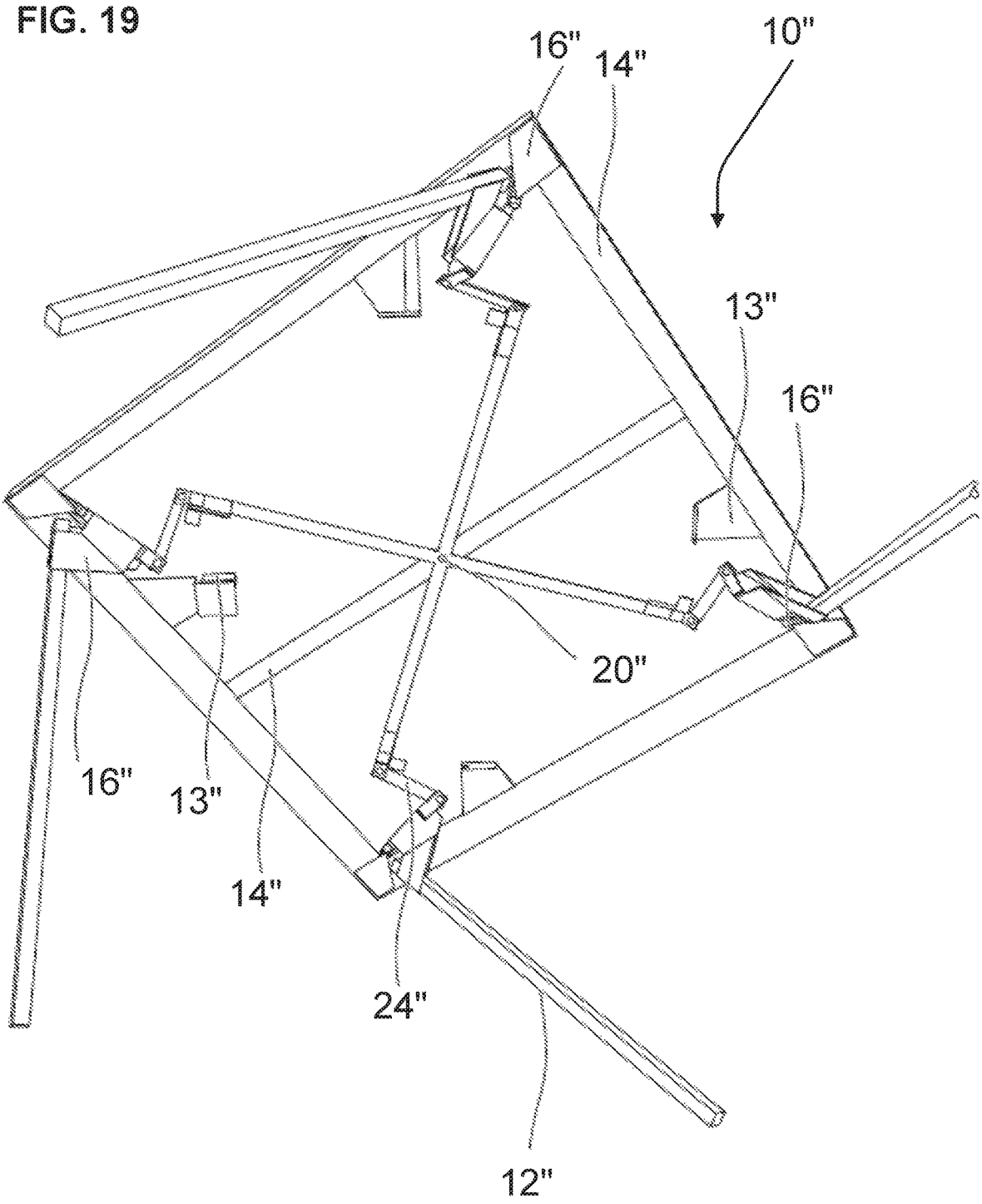

FIG. 11 illustrates the geometry of one quadrant of an example folding table 10 with simultaneously extending legs 12*a-d* with the links (e.g., folding members 24*a-d* and 26*a-d*) laid out flat. The links can be cut and hinges or the like are attached at the correct positions and orientations by scaling up the structure illustrated in FIG. 11, e.g., for use as a template. FIG. 11 is also the view along line CP.

During operation, the leg rotates through 120 degrees in a plane normal to CP; and 90 degrees in the y-z plane. Expressions for the square of the length of the coupler link, l, based on retracted and extended states, appear in the equations designated below as Math 10 and Math 11. The driver link (e.g., bars 20*a-d*) and the projection of the coupler links (e.g., 24*a-d* and 26*a-d*) in the x-y plane lie along the same line in the extended configuration. This locks the legs 12*a-d* into the extended position.

Equations to vary θi and θf for determining r and l are given by:

$$p=\text{indep} \quad \text{Math 1.}$$

$$\beta_d i=\text{indep.} \quad \text{Math 2.}$$

$$\beta i=\beta_d i\cdot a\ \tan(1)/45 \quad \text{Math 3.}$$

$$\gamma=a\ \tan(1,\sqrt{(2)}) \quad \text{Math 4.}$$

$$rp=p\cdot\sin(\gamma) \quad \text{Math 5.}$$

$$zpi=(p\cdot\sin(\gamma)-rp\cdot\cos(\beta i))\cdot\cos(\gamma) \quad \text{Math 6.}$$

$$ypi=(\sqrt{(2)}*(p-rp\cdot\sin(\beta i))-zp)/2 \quad \text{Math 7.}$$

$$xpi=\sqrt{(2)}\cdot p-zp-yp \quad \text{Math 8.}$$

$$a=h-xpi;\ b=h-ypi;\ c=zpi \quad \text{Math 9.}$$

$$l^2=(b-r\cdot\cos(\theta f))^2+(h-c-r\cdot\sin(\theta f))^2+(h-a)^2 \text{ extended} \quad \text{Math 10.}$$

$$l^2=(a-r\cdot\cos(\theta i))^2+(b-r\cdot\sin(\theta i))^2+c^2 \text{ retracted} \quad \text{Math 11.}$$

Solving for r by eliminating l in Math 1 and Math 2 gives:

$$r=\frac{h\cdot(a+c)-h^2}{-b\cdot\cos(\theta f)-(h-c)\cdot\sin(\theta f)+a\cdot\cos(\theta i)+b\cdot\sin(\theta i)}. \quad \text{Math 12}$$

Solving Math 10 for l gives:

$$l=\sqrt{(a-r\cdot\cos(\theta i))^2+(b-r\cdot\sin(\theta i))^2+c^2} \quad \text{Math 13.}$$

Equations that define linkage positions for all values of βd given values for p, r and l:

$$p=\text{indep} \quad \text{Math 14.}$$

$$\beta_d=\text{indep} \quad \text{Math 15.}$$

$$\beta=\beta_d\cdot a\ \tan(1)/45 \quad \text{Math 16.}$$

$$\gamma=a\ \tan(1/\sqrt{(2)}) \quad \text{Math 17.}$$

$$rp=p\cdot\sin(\gamma) \quad \text{Math 18.}$$

$$zp=(p\cdot\sin(\gamma)-rp\cdot\cos(\beta))\cdot\cos(\gamma) \quad \text{Math 19.}$$

$$xp=\sqrt{(2)}\cdot p-zp-yp \quad \text{Math 20.}$$

$$yp=(\sqrt{(2)}*(p-rp\cdot\sin(\beta))-zp)/2 \quad \text{Math 21.}$$

$$C=(h-xp)^2+(h-yp)^2+zp^2+r^2-l^2 \quad \text{Math 22.}$$

$$a1=-(h-xp)^2-(h-yp)^2 \quad \text{Math 23.}$$

$$b1+C\cdot(h-yp)/r \quad \text{Math 24.}$$

$$c1=(h-xp)^2-(C/(2\cdot r))^2 \quad \text{Math 25.}$$

$$\theta=(a\ \sin(\sqrt{(b1^2-4\cdot a1\cdot c1)}-b1)/(2\cdot a1)) \quad \text{Math 26.}$$

The distance from A and A' to point P is:

$$AP=\sqrt{h^2+r^2} \quad \text{Math 27.}$$

The distance from point O to point P is:

$$OP=h \quad \text{Math 28.}$$

The distance from point C to point P is:

$$CP=\sqrt{3\cdot h^2} \quad \text{Math 29.}$$

The distance from point B and B' to point P is:

$$BP=\sqrt{a^2+b^2+(h-c)^2} \quad \text{Math 30.}$$

The angle between OP and AP is:

$$OPA=a\ \cos((AP^2+h^2-r^2)/(2\cdot AP\cdot h))( \quad \text{Math 31.}$$

The angle between AP and BP is:

$$APB=a\ \cos((BP^2+AP^2-l^2)/(2\cdot BP\cdot AP)) \quad \text{Math 32.}$$

The angle between BP and CP is:

$$BPC=a\ \cos((CP^2+BP^2-p^2)/(2\cdot CP\cdot BP)) \quad \text{Math 33.}$$

The length of segment AC in the retracted configuration is:

$$AC=\sqrt{h-r\cdot\cos(\theta i))^2+(h-r\cdot\sin(\theta i))^2} \quad \text{Math 34.}$$

The length of line segment OB in the retracted configuration is:

$$OB=\sqrt{a^2+b^2+c^2} \quad \text{Math 35.}$$

The angle between AP and CP in the retracted configuration is:

$$APC=a\ \cos((CP^2+AP^2-AC^2)/(2\cdot CP\cdot AP)) \quad \text{Math 36.}$$

The angle between OP and BP in the retracted configuration is:

$$OPB=a\ \cos((BP^2+h^2-OB^2)/(2\cdot BP\cdot h)) \quad \text{Math 37.}$$

The angle between projections of AB and BC onto a plane normal to BP in the retracted configuration is:

$$aBc=a\ \cos((\cos(APC)-\cos(BPC)\cdot\cos(APB))/(\sin(BPC)\cdot\sin(APB))) \quad \text{Math 38.}$$

The angle between projections of OA and AB onto a plane normal to AP in the retracted configuration is:

$$oAb=a\ \cos((\cos(OPB)-\cos(APB)\cdot\cos(OPA))/(\sin(APB)\cdot\sin(OPA))) \quad \text{Math 39.}$$

The length of segment A'C in the extended configuration is:

$$A'C=\sqrt{((h-r\cdot\cos(\theta f))^2+(h-r\cdot\sin(\theta f))^2)} \quad \text{Math 40.}$$

The angle between AP and CP in the extended configuration is:

$$A'PC=a\cos((CP^2+AP^2-A'C^2)/(2\cdot CP\cdot AP)) \quad \text{Math 41.}$$

The angle between projections of A'B' and B'C' onto a plane normal to BP in the extended configuration is:

$$a'B'c=a\cos((\cos(A'PC)-\cos(BPC)\cdot\cos(APB))/(\sin(BPC)\cdot\sin(APB))) \quad \text{Math 42.}$$

$$OB'=\sqrt[2]{b^2+(h-c)^2+(h-a)^2} \quad \text{Math 43.}$$

$$OPB'=a\cos((BP^2+h^2-OB'^2)/(2\cdot BP\cdot h)) \quad \text{Math 44.}$$

The angle between projections of OA' and A'B' onto a plane normal to AP in the extended configuration is:

$$oA'b'=a\cos((\cos(OPB')-\cos(APB)\cdot\cos(OPA))/(\sin(APB)\cdot\sin(OPA))) \quad \text{Math 45.}$$

The following example involves the following independent values:

$\beta_d=-32$;
p=4.2426;
h=10;
θi=0.4091
radians=23.440 degrees;
θf=0.9965
radians=56.995 degrees
From which the following are calculated:

| Dimension | r(OA) | l(AB) | p (BC) | AP | OP | CP | BP |
|---|---|---|---|---|---|---|---|
| Value | 9.8954 | 2.5281 | 4.2426 | 14.0686 | 10.0000 | 17.3205 | 14.0712 |
| Math No. | 12 | 13 | indep | 27 | 28 | 29 | 30 |

The driver link and the projection of the coupler link in the x-y plane lie very nearly along the same line in the extended configuration. This locks the legs into the extended position.

FIG. 12-15 illustrate operation of another example folding table 10' with simultaneously extending legs. It is noted that the prime designation is used for reference numbers designating like components as those already described above, without repeating that description herein. Likewise, only one corner is shown in FIGS. 12-15, however the table 10' would include more corners (e.g., four corners as table 10 does).

The example folding table 10' includes a table top structure 14'. A leg support member 16' is provided on each corner of the table top structure 14' to movably (e.g., via a pivot connector) attach each of the legs 12' to the corners of the table top structure 14'.

In an example, the table 10' has a four bar linkage pivotally connected in a center of the table top structure 14'. The four bar linkage includes four separate bars 20', The bars 20' extend out from the center of the table top structure 14' and are configured substantially perpendicular to the adjacent bars, as already described above for table 10.

In an example, the table top structure 14' is not a monolithic flat table (as table top structure 14). Instead, a frame provides attachment points for the corner hinges and other anchoring hardware. A light, thin working surface for the table is attached last. There is a tab on each driver link near the hinge between the driver link and the coupler link. This tab slides into a tapered slot in a metal piece attached to the frame as the final step in the extension process. This provides rigidity to the leg while the table is being used.

In this example, the coupler link 24'*a-d* is shortened to increase the moment arm on the driven link 26'*a-d*, where the coupler link 24'*a-d* provides the stabilizing force for the extended legs. Shortening the coupler link 24'*a-d* force the extended and retracted configurations to change. The driver links 26'*a-d* and coupler links 24'*a-d* may be made of heavy sheet metal to reduce weight and cost.

During operation, the four bar linkage rotates about the center of the table (e.g., at pivot 22'). In the example shown, the four bar linkage rotates in a clockwise direction although the mechanism is not limited to rotation on the clockwise direction, and in other examples may be a counter-clockwise rotation.

A first folding member 24' is rotatably connected at an end of each of the four separate bars 20', respectively. In an example, the first folding member 24' is movably connected by a hinge, but other pivoting attachment may be implemented. A second folding member 26' is movably connected to the corresponding first folding member 24' on one end, and the second folding member 26' is rotatably connected to a corresponding leg support member 16' on a second end of the second folding member.

In an example, the first folding member 24' is connected to the end of the respective bar 20' by a pivot member 30'. In this example, the pivot members 30' are pivot pins. The second folding member 26' is also movably connected on both ends by pivot pins 32' and 34'. Operation to extend and retract the legs 12' of the table 10' are similar to those already described above and the operation is not described again herein.

It is noted that the pivot member could be a hinge or ball and socket. The rigor of the design allows either inexpensive simple hinges or more expensive ball and socket pivots to be implemented. This allows extra design freedom. In addition, ball and socket pivots also allow designs for which pivot pins would be in lines that wouldn't intersect.

FIGS. 16-19 illustrate the example folding table 10" with simultaneously extending legs. It is noted that the double-prime designation is used for reference numbers designating like components as those already described above, without repeating that description herein. In the math equations discussed above, l=3.7870 is replaced by l=2.5281; $\beta_d=0$ is replaced by $\beta_d=-32$.

The example folding table 10" includes a table top structure 14". A leg support member 16" is provided on each corner of the table top structure 14" to movably (e.g., via a pivot connector) attach each of the legs 12" to the corners of the table top structure 14". The table top structure 14" also includes a frame about the perimeter or outer edge.

In an example, the table 10" has a four bar linkage pivotally connected in a center of the table top structure 14". The four bar linkage includes four separate bars 20". The bars 20" extend out from the center of the table top structure 14" and are configured substantially perpendicular to the adjacent bars, as already described above for table 10.

In an example, the table top structure 14" is not a monolithic flat table (as table top structure 14). Instead, a frame about the perimeter and across the center provides attachment points for the corner hinges and other anchoring hardware. A light, thin working surface for the table is attached last. There is a tab on each driver link near the hinge between the driver link and the coupler link. This tab slides into a tapered slot in a metal piece attached to the frame as the final step in the extension process. This provides rigidity to the leg while the table is being used.

In this example, the coupler link 24" is shortened to increase the moment arm on the driven link 26", where the coupler link 24" provides the stabilizing force for the extended legs. Shortening the coupler link 24" force the extended and retracted configurations to change. The driver links 26" and coupler links 24" may be made of heavy sheet metal to reduce weight and cost.

During operation, the four bar linkage rotates about the center of the table (e.g., at pivot 22"). In the example shown, the four bar linkage rotates in a clockwise direction, although the mechanism is not limited to rotation on the clockwise direction, and in other examples may be a counter-clockwise rotation.

It is noted that the examples shown and described are provided for purposes of illustration and are not intended to be limiting. Still other examples are also contemplated.

The invention claimed is:

1. A folding table with simultaneously extending legs, comprising:

a table top structure;

a driver component attached at a center of the table top structure:

a plurality of table legs to support the table top structure, each of the table legs operated by rotation of the driver component;

a plurality of driver links connected to the driver component, each of the plurality of driver links corresponding to separate of the plurality of table legs;

a plurality of coupler links corresponding to separate of the plurality of driver links for each table leg, the plurality of coupler links pivotally connecting the corresponding table leg to the corresponding one of the plurality of driver links;

a table leg support member attached to the top structure for each table leg, the table leg support member makes an angle of about 35 degrees with a plane of the table top structure; and wherein when one of the table legs is folded and unfolded, the other table legs move simultaneously in a first direction to open and in a second direction to retract.

2. The folding table of claim 1, wherein pressing the driver links against the table top structure secures the table legs in a closed position.

3. The folding table of claim 1, wherein pressing the driver links in an extended position secures the table legs in an open position.

4. The folding table of claim 1, wherein tipping the table top structure over causes the legs to automatically release and unfold into a standing position.

5. A folding table with simultaneously extending legs, comprising:

a table top structure;

a leg support member on each corner of the table top structure, each leg support member having three edges defined by adjacent surfaces, the three edges arranged adjacent to one another to form a triangular-shaped face of the leg support member, and each leg support member having a hinge face angled relative to the triangular-shaped face of the leg support member to receive a first hinge thereon;

a driver member pivotally connected in a center of the table top structure, the driver member including a plurality of separate bars each extended out from the center of the table top and each of the plurality of separate bars having substantially a same angle relative to an adjacent one of the plurality of separate bars;

a first folding member connected by a second hinge at an end of each of the plurality of separate bars;

a second folding member connected by a third hinge to the first folding member on one end, and the second folding member connected by the first hinge to the hinge face of one of the leg support members on a second end;

a plurality of table legs to support the table top structure, each of the table legs connected to the second folding member;

wherein when one of the table legs is folded and unfolded, the other table legs move simultaneously in a first direction to open and in a second direction to retract.

6. The folding table of claim 5, wherein rotation of the driver member about the center of the table top structure causes the first folding member to move away from the table top structure.

7. The folding table of claim 5, wherein the first folding member moving away from the table top structure also causes the second folding member to move away from the table top structure.

8. The folding table of claim 5, wherein the first folding member and the second folding member are mounted at angles which cause the table legs to move simultaneously in a first direction to open and in a second direction to retract.

9. The folding table of claim 5, wherein each of the first folding member is connected to the end of the corresponding one of the plurality of separate bars by a pivot member.

10. The folding table of claim 9, wherein the pivot member is a hinge.

11. The folding table of claim 9, wherein the pivot member is a pivot pin.

12. The folding table of claim 5, wherein the second folding member is rotatably connected on both ends by a pivot member.

13. The folding table of claim 12, wherein the pivot member is a hinge.

14. The folding table of claim 12, wherein the pivot member is a pivot pin.

15. A folding table with simultaneously extending legs, comprising:

a table top structure;

a plurality of leg support members for the table top structure, each of the leg support members having three edges defined by adjacent surfaces, the three edges together defining a triangular-shaped face of the leg support member, and each of the leg support members having a hinge face angled relative to the triangular-shaped face of the leg support member to receive a first hinge thereon;

a four bar linkage pivotally connected in a center of the table top structure, the four bar linkage including four separate bar members extending outward from the center of the table top substantially perpendicular to two adjacent bar members;

a first folding member rotatably connected at an end of each of the four separate bar members;

a second folding member rotatably connected to the first folding member on one end, and the second folding member rotatably connected to one of the leg support members on a second end;

a plurality of table legs to support the table top structure, each of the table legs connected to the second folding member;

wherein rotation of the four bar linkage about the center of the table top structure causes the first folding member to move away from the table top structure;

wherein the first folding member moving away from the table top structure also causes the second folding member to move away from the table top structure; and wherein the first folding member and the second folding member are mounted at angles which cause the table legs to move simultaneously in a first direction to open and in a second direction to retract.

16. The folding table of claim 15, wherein the first folding member is connected to the end of the bar by a pivot member.

17. The folding table of claim 15, wherein the second folding member is rotatably connected on both ends by a pivot member.

* * * * *